United States Patent [19]

Hayashi et al.

[11] 4,119,415

[45] Oct. 10, 1978

[54] ELECTROSTATIC DUST PRECIPITATOR

[75] Inventors: Kazuo Hayashi; Ken Kamijo, both of Yokohama, Japan

[73] Assignee: Nissan Motor Company, Ltd., Yokohama, Japan

[21] Appl. No.: 808,684

[22] Filed: Jun. 22, 1977

[51] Int. Cl.[2] ..... B03C 3/00

[52] U.S. Cl. ..... 55/124; 55/131; 55/137; 55/147; 55/148; 55/151; 55/154

[58] Field of Search ..... 55/124–126, 55/131, 136–138, 151, 154, 147, 148

[56] References Cited

U.S. PATENT DOCUMENTS

| | | | |
|---|---|---|---|
| 3,862,826 | 1/1975 | Haupt | 55/138 |
| 3,988,131 | 10/1976 | Kanazawa et al. | 55/126 |
| 4,007,024 | 2/1977 | Sallee et al. | 55/138 |

FOREIGN PATENT DOCUMENTS

| | | | |
|---|---|---|---|
| 2,405,528 | 8/1974 | Fed. Rep. of Germany | 55/150 |
| 1,410,881 | 8/1965 | France | 55/151 |

*Primary Examiner*—Bernard Nozick

*Attorney, Agent, or Firm*—Lane, Aitken, Dunner & Ziems

[57] ABSTRACT

An electrostatic dust precipitator as a gas cleaner in which a grounded, perforated metal filter is located at the gas inlet end of the space between a pair of grounded dust collecting electrodes having a discharge wire located therebetween so that electrostatic fields are developed not only between the discharge wire and the dust collecting electrodes but between the discharge wire and the metal filter.

2 Claims, 5 Drawing Figures

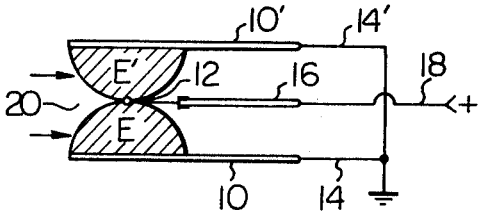
Fig. 1
PRIOR ART
Fig. 2
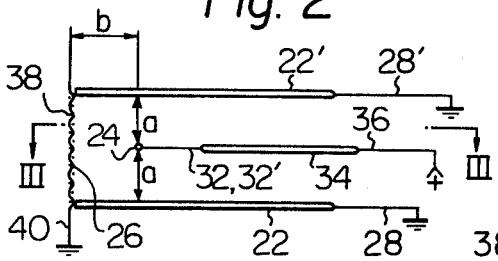
Fig. 3
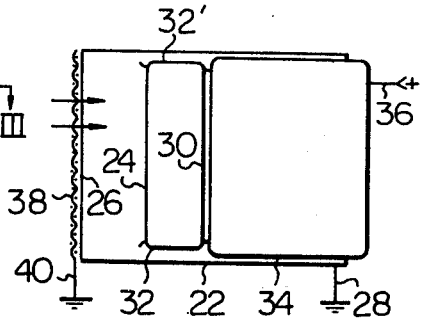
Fig. 4
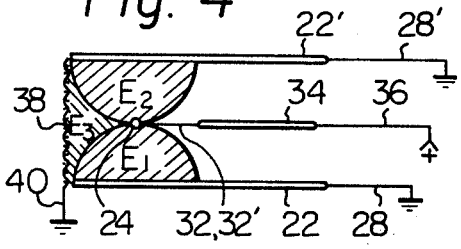
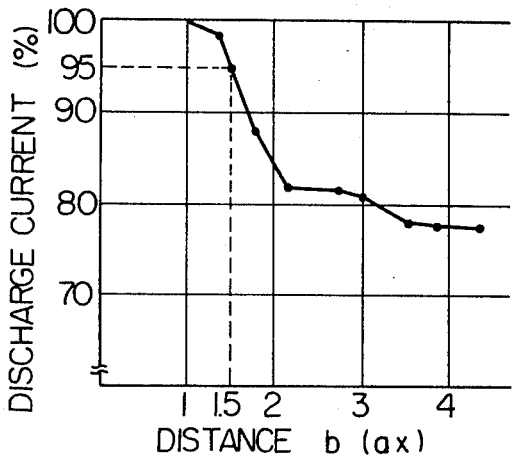
Fig. 5

ELECTROSTATIC DUST PRECIPITATOR

The present invention relates in general to gas cleaners and, particularly, to an electrostatic dust precipitator for removing dust particles from dust laden gas such as air.

Electrostatic dust precipitators presently in use are generally designed to remove dust particles of 0.01 to 10 microns in diameter from dust laden air. For the removal of dust particles and flues of larger sizes, a perforated screening filter is used in combination with an electrostatic dust precipitator so that such particles and flues are collected by the screening filter before the dust laden air is passed to the dust precipitator.

A conventional electrostatic dust precipitator largely consists of a pair of grounded, spaced parallel electrode plates and a high-voltage electrode plate connected to a straight discharge wire positioned between the grounded electrode plates and electrically connected to a source of d.c. voltage. When the high-voltage electrode plate is energized, an active electrostatic field is established between the discharge wire and each of the electrode plates so that a corona discharge takes place from the discharge wire to each electrode plate. The dust particles in the dust laden air entering the space between the grounded electrode plates are ionized by the electrostatic fields thus produced around the discharge wire and are attracted to and deposited on the inner faces of the electrode plates. The dust collection efficiency of an electrostatic dust precipitator of this nature depends upon the strengths and the dimensional extents of the active electrostatic fields to be developed around the discharge wire and can therefore be increased by increasing the voltage to be supplied to the high-voltage electrode plate. However, the use of an increased voltage not only gives rise to an increase in the loss of the electric power to be consumed by the precipitator but requires an enlarged overall construction of the unit and is objectionable from practical points of view.

It is, accordingly, a prime object of the present invention to provide an improved electrostatic dust precipitator capable of achieving an enhanced dust collection efficiency without having recourse to the use of an increased voltage.

In accordance with the present invention, such an object will be accomplished by an electrostatic dust precipitator which basically comprises a pair of grounded electrodes having respective inner faces which are spaced apart substantially in parallel from each other a predetermined distance $2a$ and which form a gas inlet end at one end of the space between the electrodes, an electrically conductive line located between and substantially in parallel with the inner faces of the electrodes, the conductive line being to be electrically connected to a source of d.c. voltage, and a grounded, perforated metal filter positioned at the gas inlet end substantially perpendicularly to the inner faces of the electrodes and substantially in parallel with the conductive line, wherein the conductive line is spaced apart a predetermined distance $a$ from the inner face of each of the electrodes and a predetermined distance $b$ from the metal filter and wherein the distance $b$ between the conductive line and the metal filter is not less than the distance $a$ between the conductive line and each of the electrodes and not more than 1.5 times the distance $a$. The electrostatic dust precipitator may further comprise means for holding the conductive line in position between the grounded electrodes, the means including an elastic metal wire having opposite end portions respectively in retaining engagement with opposite end portions of the conductive line and having the conductive line stretched between the opposite end portions of the metal wire.

The features and advantages of an electrostatic dust precipitator according to the present invention will be more clearly appreciated from the following description taken in conjunction with the accompanying drawing in which:

FIG. 1 is a schematic side elevation view showing a representative example of a prior-art electrostatic dust precipitator of the character to which the present invention appertains;

FIG. 2 is a schematic side elevation view showing, partly in section, a preferred embodiment of an electrostatic dust precipitator according to the present invention;

FIG. 3 is a plan view showing, partly in section, part of the electrostatic dust precipitator of FIG. 2 as viewed downwardly from a plane indicated by line III—III in FIG. 2;

FIG. 4 is a view similar to FIG. 2 but shows active electrostatic fields obtained in the electrostatic dust precipitator embodying the present invention; and FIG. 5 is a graphic representation of the variation in the corona discharge current produced in the dust precipitator of FIGS. 2 and 3 when a certain dimensional parameter is varied in the dust precipitator.

Referring to FIG. 1 of the drawing, a known electrostatic dust precipitator of the single-stage type is shown comprising a pair of dust collecting plates 10 and 10' which are spaced apart in parallel from each other and a straight discharge wire 12 which is located between the collecting electrode plates 10 and 10' and which is equally spaced apart from the respective inner faces of the electrode plates 10 and 10'. The collecting electrode plates 10 and 10' are grounded by lines 14 and 14' respectively, while the discharge wire 12 is secured to an auxiliary electrode plate 16 which is connected by a line 18 to a suitable source (not shown) of a d.c. voltage. The dust precipitator thus constructed has a gas inlet end 20 at one end of the space between the electrode plates 10 and 10' and, during operation, there is induced a flow of dust laden gas entering the space between the electrode plates 10 and 10' through the gas inlet end 20 as indicated by arrows.

When the discharge wire 12 is energized by a d.c. voltage which is supplied to the wire 12 through the line 18 and the auxiliary electrode plate 16, active electrostatic fields E and E' are developed between the discharge wire 12 and the respective inner faces of the electrode plates 10 and 10' and are distributed generally in semicylindrical patterns as indicated by hatched areas. The dust collection efficiency of the precipitator is dictated mostly by the strengths of these electrostatic fields and, for this reason, there has been a limitation in increasing the dust collection efficiency as previously noted. The object of the present invention is to enhance the dust collection efficiency of an electrostatic dust precipitator of the basic construction illustrated in FIG. 1 without resort to the use of an increased d.c. voltage for the discharge wire 12 and without enlarging the overall dimension of the precipitator.

Referring to FIGS. 2 and 3, an electrostatic dust precipitator embodying the present invention comprises a pair of substantially coextensive dust collecting electrodes 22 and 22′ of plate forms and an electrically conductive line constituted by a corona discharge wire 24. The dust collecting electrodes 22 and 22′ have respective inner faces which are substantially parallel with the front and rear dimension of the precipitator construction and which are spaced apart substantially in parallel from each other a predetermined distance 2*a* in a direction substantially normal to the above-mentioned front and rear dimension, the electrodes 22 and 22′ having formed therebetween an internal space having a front gas inlet end 26 which is substantially normal to the front and rear dimension of the precipitator construction end 26 at one end of the space between the electrodes 22 and 22′. The discharge wire 24 is located between and substantially in parallel with the respective inner faces of the electrodes 22 and 22′ and is substantially equidistantly spaced apart from the inner faces of the electrodes 22 and 22′. The spacing between the inner faces of the electrodes 22 and 22′ being assumed to be 2*a* as above noted, the distance between the discharge wire 24 and the inner face of each of the electrodes 22 and 22′ is *a* as indicated in FIG. 2. The discharge wire 24 is, furthermore, located in parallel with the gas inlet end 26 and is spaced apart a predetermined distance *b* from the gas inlet end 26 as is also indicated in FIG. 2. The dust collecting electrodes 22 and 22′ are connected to ground by lines 28 and 28′, respectively, while the discharge wire 24 is electrically connected to and fixedly held in position by an elastic metal wire 30 which is also located between the electrode plates 22 and 22′ and on the remoter side of the wire 24 from the gas inlet end 26. The elastic metal wire 30 has hook-shaped opposite end portions 32 and 32′ which extend substantially perpendicularly toward the gas inlet end 26 and which are respectively in elastically retaining engagement with opposite end portions of the discharge wire 24 so that the discharge wire 24 is stretched straight between the opposite end portions 32 and 32′ of the elastic metal wire 30 as shown in FIG. 3. The elastic metal wire 30 is secured to an auxiliary electrode 34 which in turn is connected to a suitable source (not shown) of positive d.c. voltage by a line 36. The source of the d.c. voltage may be composed of a transformer and a mechanical or electronic rectifier as is well known in the art.

The electrostatic dust precipitator embodying the present invention further comprises a perforated metal filter 38 which is located at the gas inlet end 26 of the space between the collecting electrodes 22 and 22′ and which is grounded by a line 40. The discharge wire 24 between the collecting electrodes 22 and 22′ is thus located substantially in parallel with and at a distance of *b* from the inner face of the metal filter 38. The metal filter 38 may be composed of a wire mesh and preferably has about 10 meshes per square centimeter.

When, in operation, the discharge wire 24 is energized by a positive d.c. voltage which is supplied to the wire 24 through the line 36, auxiliary electrode 34 and elastic metal wire 30, active electrostatic fields are developed not only between the discharge wire 24 and the respective inner faces of the dust collecting electrodes 22 and 22′ as indicated by $E_1$ and $E_2$, respectively, in FIG. 2 similarly to the active electrostatic fields E and E′ in the prior-art dust precipitator shown in FIG. 1 but also between the discharge wire 24 and the inner face of the grounded metal filter 38 as indicated by $E_3$, producing corona discharges from the discharge wire 24 to the collecting electrodes 22 and 22′ and the metal filter 38. When, thus, dust laden gas is passed through the metal filter 38, the relatively large sized dust particles and/or flues contained, if any, in the gas are removed by the filter 38 from the gas entering the space between the electrodes 22 and 22′. The gas which is thus admitted past the filter 38 into the space between the dust collecting electrodes 22 and 22′ is ionized not only in the areas respectively containing the active electrostatic fields $E_1$ and $E_2$ between the discharge wire 24 and the collecting electrodes 22 and 22′ but in the area containing the active electrostatic field $E_3$ between the discharge wire 24 and the metal filter 38. As the flow of the ionized gas advances in the space between the collecting electrodes 22 and 22′ and thereafter between the auxiliary electrode 34 and each of the collecting electrodes 22 and 22′ away from the inner face of the metal filter 38, the charged dust particles in the gas are attracted toward the inner faces of the electrodes 22 and 22′ and are finally deposited thereon. As compared with a prior-art dust precipitator of the nature shown in FIG. 1, the dust precipitator embodying the present invention is capable of providing a dust collection efficiency which is higher than that achievable in the prior-art precipitator by a value which corresponds to the strength of the additional electrostatic field $E_3$ developed between the discharge wire 24 and the metal filter 38.

The total corona discharge current from the discharge wire 24 to the metal filter 38 and the collecting electrodes 22 and 22′ varies with the distance *b* therebetween if the d.c. voltage impressed on the discharge wire 24 is maintained constant. FIG. 5 shows such variation in the corona discharge current depending upon the distance *b* which is indicated as multiples of the distance *a* between the discharge wire 24 and the inner face of each of the dust collecting electrodes 22 and 22′. The discharge current is indicated in terms of percentage which is indexed at 100 when the distance *b* equals the distance *a*. From the plot shown in FIG. 5, it is seen that there is a tendency that the total discharge current from the discharge wire 24 to the collecting electrode 22 and 22′ and the metal filter 38 increases as the distance *b* therebetween is made shorter as compared with the distance *a* between the discharge wire 24 and each of the dust collecting electrodes 22 and 22′. To achieve a satisfactory discharge current from the discharge wire 24 to the electrode 22 and 22′ and the filter 38, therefore, it is preferable to have the discharge wire 24 located as close to the filter 38 as possible. Experiments have however revealed that the intensity of the corona discharge between the discharge wire 24 and each of the dust collecting electrodes 22 and 22′ diminishes and accordingly the dust collection efficiency of the unit deteriorates more seriously as the discharge wire 24 is located closer to the metal filter 38. Further experiments have therefore been conducted in quest of an optimum compromise between these conflicting qualifications. The results of these experiments show that an excellent dust collection efficiency is achievable if the corona discharge current from the discharge wire 24 to the dust collecting electrodes 22 and 22′ and the metal filter 38 is reduced by less than about 5 percent from the value achieved when the distance *b* therebetween is equal to the distance *a* between the discharge wire 24 and each of the dust collecting electrodes 22 and 22′. From the plot of FIG. 5 it is seen that the distance *b* corresponding to the particular limit of the corona discharge current from the discharge wire 24 to the collecting electrodes 22 and 22' and the filter 38 is 1.5 times the distance *a* between the discharge wire and each dust collecting electrode. In the electrostatic dust precipitator according to the present invention, therefore, the discharge wire 24 is located with respect to the dust collecting electrodes 22 and 22' and the metal filter 38 in such a manner that the distance *b* of the discharge wire 24 from the metal filter 38 is not less than the distance *a* between the discharge wire 24 and each of the dust collecting electrodes 22 and 22' and not more than 1.5 times the distance *a*.

The grounded metal filter 38 forming part of the dust precipitator according to the present invention is not only conducive to increasing the total electrostatic field to be developed in the unit but serves as a screen for preliminarily collecting relatively coarse dust particles in the gas to be passed through the unit and further as protective means for isolating an operator of the dust precipitator from the current in the discharge wire.

What is claimed is:

1. An electrostatic dust precipitator having a front and rear dimension and comprising a pair of substantially coextensive, grounded electrodes having respective inner faces which are substantially parallel with said front and rear dimension and which are spaced apart from each other a predetermined distance 2*a* in a direction substantially normal to said front and rear dimension, the electrodes having formed therebetween an internal space having a front end substantially normal to said front and rear dimension, an electrically conductive line located between and substantially parallel with the inner faces of said electrodes, the conductive line being electrically connected to a source of d.c. voltage, and a grounded, perforated metal filter positioned at said front end substantially perpendicularly to the inner faces of said electrodes and substantially in parallel with said conductive line, wherein said conductive line is spaced apart a predetermined distance *a* from the inner face of each of said electrodes and a predetermined *b* from said metal filter positioned at said front end immediately adjacent the edges of the grounded electrodes and wherein said distance *b* is not less than the distance *a* and not more than 1.5 times the distance *a*.

2. An electrostatic dust precipitator as set forth in claim 1, further comprising means for holding said conductive line in position between said grounded electrodes, said means including a metal wire having opposite end portions respectively in retaining engagement with opposite end portions of said conductive line and having the conductive line stretched between the opposite end portions of the metal wire.

* * * * *